US008717092B1

(12) United States Patent
Antunes Ribafeita et al.

(10) Patent No.: US 8,717,092 B1
(45) Date of Patent: May 6, 2014

(54) CURRENT MIRROR CIRCUIT

(71) Applicants: Rui Filipe Antunes Ribafeita, Lawrenceville, GA (US); Michael Wayne Trippe, Norcross, GA (US)

(72) Inventors: Rui Filipe Antunes Ribafeita, Lawrenceville, GA (US); Michael Wayne Trippe, Norcross, GA (US)

(73) Assignee: Anadigics, Inc., Warren, NJ (US)

( * ) Notice: Subject to any disclaimer, the term of this patent is extended or adjusted under 35 U.S.C. 154(b) by 0 days.

(21) Appl. No.: 13/724,256

(22) Filed: Dec. 21, 2012

(51) Int. Cl.
*G05F 1/10* (2006.01)

(52) U.S. Cl.
USPC ..... 327/542

(58) Field of Classification Search
USPC ..... 323/315; 327/537, 538, 542, 543
See application file for complete search history.

(56) References Cited

U.S. PATENT DOCUMENTS

| | | | | | |
|---|---|---|---|---|---|
| 4,327,321 | A * | 4/1982 | Suzuki et al. | ..... | 323/315 |
| 5,675,243 | A * | 10/1997 | Kamata | ..... | 323/313 |
| 5,721,512 | A * | 2/1998 | Bowers | ..... | 330/288 |
| 5,886,571 | A * | 3/1999 | Suwabe | ..... | 327/541 |
| 8,049,483 | B2 * | 11/2011 | Yamamoto et al. | ..... | 323/313 |

* cited by examiner

*Primary Examiner* — Jeffrey Zweizig
(74) *Attorney, Agent, or Firm* — William L. Botjer

(57) ABSTRACT

An improved current mirror circuit. The current mirror circuit includes a current mirror base network, a current source transistor, and an error transistor. The current mirror base network includes a first terminal, a second terminal, and a third terminal. The first terminal is connected to the current source transistor through a first impedance element. The second terminal is connected to the error transistor. The third terminal is connected to a first bias voltage source, and the first terminal is connected to a second bias voltage source.

16 Claims, 2 Drawing Sheets

CURRENT MIRROR CIRCUIT

TECHNICAL FIELD

The present invention generally relates to current mirror circuits. More specifically, the present invention relates to a circuit arrangement for compensating variations in the current of a current mirror circuit.

BACKGROUND OF THE INVENTION

Recently, radio frequency (RF) and microwave power amplifiers have been used in the field of communication as they generate a relatively high amount of power that is useful in wireless communication systems. The RF and microwave power amplifiers are biased with various types of circuits. A well known type of circuit used for biasing is a current mirror circuit. In a typical current mirror circuit, a current source network is used to establish a reference current, provides up the current mirror. The current source network thus serves as a simple current regulator, supplying nearly constant current to a load over a wide range of load resistances.

In many RF and microwave power amplifiers, a resistor with a large value forms the current source network in the current mirror circuit. This approach is adequate in situations where the supply voltage is large. However, most battery operated circuits have a relatively low supply voltage, which renders the use of simple resistor biasing in the current mirror circuit inadequate. In order to overcome such limitations, alternative biasing methods are sometimes used, for example using a Gallium Arsenide Hetero-junction Bipolar Transistor (GaAs HBT) device to source the reference current from current source network. It will be seen that due to a relatively high value of base-emitter voltage in the device it may not be very reliable. In addition, the circuits using a GaAs HBT device tend to be very sensitive to changes in device behavior over long periods of high volume manufacturing.

In view of the foregoing, an improved current mirror circuit that is adaptive to supply voltage and ambient temperature variations, and tolerant to manufacturing variations is desirable.

SUMMARY OF THE INVENTION

According to embodiments illustrated herein, there is provided a current mirror circuit. The current mirror circuit includes a current mirror base network, a current source transistor, and an error transistor. The current mirror base network further includes a first terminal, a second terminal, and a third terminal, wherein the third terminal is connected to a first bias voltage source. The source terminal of the current source transistor is connected to the first terminal through a first impedance element, the gate terminal of the current source transistor is connected to the first terminal, and the drain terminal of the current source transistor is connected to a second bias voltage source. The emitter terminal of the error transistor is connected to the second terminal, the base terminal of the error transistor is connected to a source terminal of the current source transistor, and the collector terminal of the error transistor is connected to the third terminal.

The current mirror base network includes a first transistor and a second transistor. The base terminal of the first transistor is connected to the base terminal of the second transistor at the second terminal, the emitter terminal of the first transistor and the emitter terminal of the second transistor are grounded, the collector terminal of the first transistor is connected to the first terminal, and the collector terminal of the second transistor is connected to the third terminal.

The current source transistor and first impedance element are combined to form a current source configuration. The current source configuration provides a reference current to the current mirror base network that helps in maintaining the proper bias point and operating conditions in the current mirror circuit, which can be useful for associated circuits such as RF and microwave power amplifiers. Further, the combination of current source transistor and the first impedance element minimizes the variations in the current flowing through the current source transistor facilitating more stable operation. Thus, associated circuits can operate under more stable conditions.

BRIEF DESCRIPTION OF THE DRAWINGS

The detailed description of the embodiments of the invention will hereinafter be described in conjunction with the appended drawings provided to illustrate and not to limit the invention, wherein like designations denote like elements, and in which.

DESCRIPTION OF THE PREFERRED EMBODIMENTS

The invention can be best understood with reference to the detailed figures and description set forth herein. Various embodiments are discussed below with reference to the figures. However, those of ordinary skill in the art will readily appreciate that the detailed description given herein with respect to these figures is just for explanatory purposes. The disclosed systems extend beyond the described embodiments. For example, those of ordinary skill in the art will appreciate that in light of the teachings presented, multiple alternate and suitable approaches may be realized, to implement the functionality of any detail described herein, beyond the particular implementation choices in the following embodiments described and shown.

Figure 1:
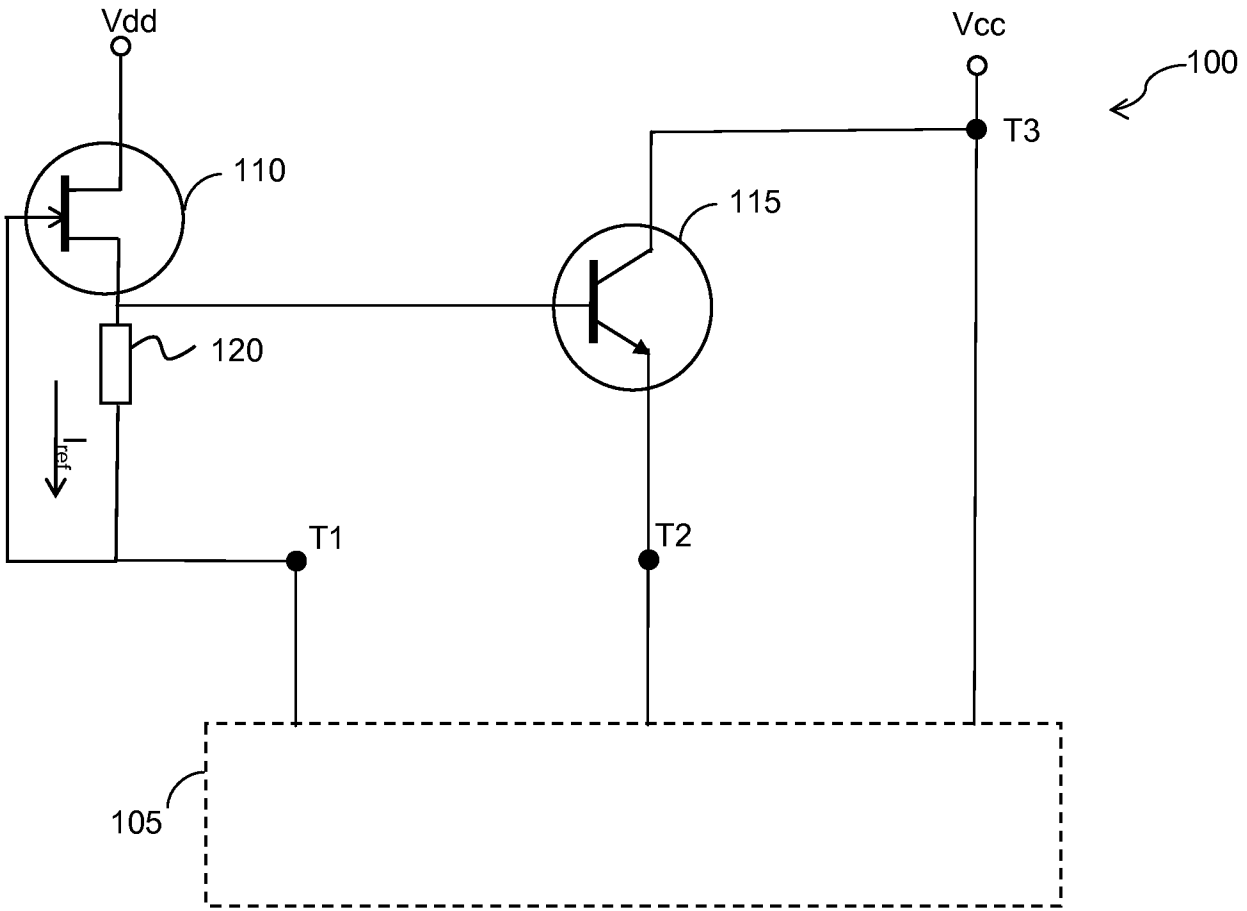
FIG. 1 illustrates a current mirror circuit in accordance with an embodiment of the invention.

FIG. 1 illustrates a current mirror circuit 100 in accordance with an embodiment of the invention. Current mirror circuit 100 includes a current mirror base network 105, a current source transistor 110, and an error transistor 115. Current mirror base network 105 includes a first terminal T1, a second terminal T2, and a third terminal T3 that is connected to a first bias voltage source providing supply voltage Vcc.

Current source transistor 110 includes a drain terminal, a gate terminal, and a source terminal. The drain terminal is connected to a second bias voltage source (not shown) supplying a bias voltage Vdd. The gate terminal is connected to the first terminal T1 of current mirror base network 105. The source terminal is connected to the first terminal T1 through a first impedance element 120 (e.g., a resistor). The emitter terminal of error transistor 115 is connected to the second terminal T2 of current mirror base network 105. The base terminal of error transistor 115 is connected to source terminal of current source transistor 110. The collector terminal of error transistor 115 is connected to the third terminal T3 of current mirror base network 105.

When current mirror base network 105 sources current, it sources from a combination of current source transistor 110 together with first impedance element 120 which forms a current source configuration. First impedance element 120 provides a negative feedback signal to current source transistor 110. Thus, first impedance element 120 helps negate the variations of current flowing through current source transistor 110. The variations may arise due to temperature variations and manufacturing variations of current source transistor 110. The current source configuration, thus, provides a constant reference current $I_{ref}$ to the first terminal T1 of current mirror base network 105. In an embodiment, current source transistor 110 is operated at greater than the pinch off voltage.

Error transistor 115 converts the voltage at the source of current source transistor 110 to an error signal, and completes the feedback loop around the second terminal T2. In addition, error transistor 115 operates as an emitter follower and does not perturb the constant reference current $I_{ref}$. Furthermore, error transistor 115 provides a high drive current to the second terminal T2 due to its low output impedance.

An example of current source transistor 110 includes, but is not limited to, a depletion mode Field Effect Transistor (FET). An example of error transistor 115 includes, but is not limited to, a Bipolar Junction Transistor (BJT) such as a Hetero-junction Bipolar Transistor (HBT).

Figure 2:
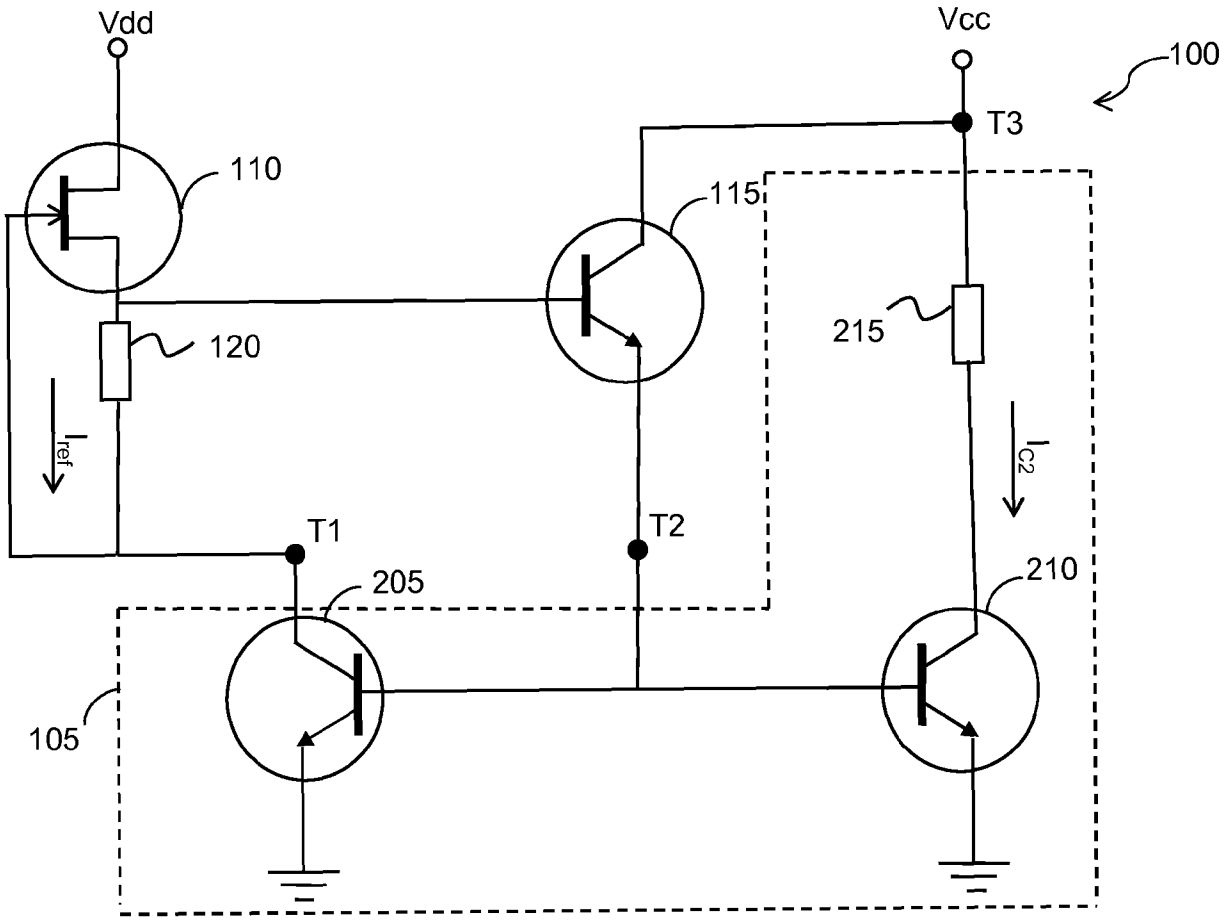
FIG. 2 illustrates a current mirror circuit in accordance with an embodiment of the invention.

FIG. 2 illustrates current mirror circuit 100 in accordance with an embodiment of the invention. The elements referenced with same the numbers in FIG. 2 as that of current mirror circuit 100 and are connected in similar fashion as explained in FIG. 1. In an embodiment, current mirror base network 105 includes a first transistor 205 and a second transistor 210. The collector terminal of first transistor 205 is connected to the first terminal T1. The emitter terminal of first transistor 205 is grounded. The base terminal of first transistor 205 is connected to the base terminal of second transistor 210 at the second terminal T2. The emitter terminal of second transistor 210 is grounded. The collector terminal of second transistor 210 is connected to the third terminal T3 through a second impedance element 215.

In an embodiment, for example, first transistor 205 and second transistor 210 are HBTs and second impedance element 215 is an inductor. It will be apparent to a person having ordinary skill in the art that current mirror circuit 100 may include differing configurations of current mirror base network 105.

In an embodiment, the constant reference current $I_{ref}$ is provided to collector terminal of first transistor 205. This constant reference current $I_{ref}$ biases first transistor 205 to a desired operating point. It will be apparent to a person having ordinary skill in the art that as first transistor 205 and second transistor 210 have the same base-emitter voltage, they will be biased to a same relative operating point. However, in normal RF circuits that use current mirror circuits, such as current mirror circuit 100, the collector current $I_{C2}$ across second transistor 210 has to be high. In contrast, first transistor 205 should consume the least possible current since first transistor 205 is only meant for biasing current mirror circuit 100. This is achieved by the differential emitter areas of first transistor 205 and second transistor 210. In current mirror circuit 100, the emitter area of second transistor 210 may typically range from 10 to 1000 times of the emitter area of first transistor 205 and more preferably 100 to 1000 times. In an exemplary embodiment, the emitter area of second transistor 210 is 3600 $\mu m^2$, and the emitter area of first transistor 205 is 10 $\mu m^2$. It will be apparent to a person having ordinary skill in the art with this arrangement of first transistor 205 and second transistor 210, the current across first transistor 205 is mirrored across second transistor 210. However, due to the differential emitter areas of first transistor 205 and second transistor 210, the current density or the current ratio across first transistor 205 and second transistor 210 is not proportional. The current density of second transistor 210 is made proportional by providing error transistor 115, which acts as a current booster by providing high drive current at the base terminal of second transistor 210. The high base current thus available across second transistor 210 is useful for the high RF drive of RF and microwave power amplifiers. In an embodiment, for example, a power amplifier is coupled at second impedance element 215 (e.g., an inductor) to current mirror circuit 100.

As a corollary, by using first transistor 205 with a small emitter area, current is utilized efficiently only for biasing current mirror circuit 100. Also, by using second transistor 210 with a large emitter area, high collector current $I_{C2}$ is made available for associated circuits such as RF circuits.

The tables below show the variations in the collector current $I_{C2}$ of second transistor 210 in current mirror circuit 100 with changes in $I_{DSS}$ (i.e., the drain-source saturation current), ambient temperature, and the bias voltage.

TABLE 1

Variations in the collector current $I_{C2}$ of the second transistor 210 due to variations in $I_{DSS}$ of the current source transistor 110

| Parameter | Decrease | Normal | Increase |
|---|---|---|---|
| $I_{DSS}$ variation of the current source transistor 110 | −25% | Nominal | +25% |
| $I_{C2}$ (mA) ; $I_{C2}$ (mA) percentage variation | 47.8 ; −4.4% | 50.0 ; 0% | 51.6 ; +3.2% |

As shown in the Table-1, the collector current $I_{C2}$ of second transistor 210 is 50 mA when $I_{DSS}$ of current source transistor 110 is nominal. It is seen that, the collector current $I_{C2}$ of second transistor 210 decreases only 4.4% even when the value of $I_{DSS}$ of current source transistor 110 decreases 25%. It is also seen that, the collector current $I_{C2}$ of second transistor 210 increases only 3.2% even when the value of $I_{DSS}$ of current source transistor 110 increases +25%.

TABLE 2

Variations in the collector current $I_{C2}$ of the second transistor 210 due to variations in temperature

| Parameter | Decrease | Normal | Increase |
|---|---|---|---|
| Temperature | −40° C. | 25° C. | +85° C. |
| $I_{C2}$ (mA) ; $I_{C2}$ (mA) percentage variation | 51.2 ; +2.4% | 50.0 ; 0% | 48.3 ; −3.4% |

As shown in the Table-2, the collector current $I_{C2}$ of second transistor 210 is 50 mA when the temperature is 25° C. It is seen that, the collector current $I_{C2}$ of second transistor 210 increases by only 2.4% even when the temperature decreases to −40° C. It is also seen that, the collector current $I_{C2}$ of second transistor 210 decreases by only 3.4% even when the temperature increases to 85° C.

TABLE 3

Variations in the collector current $I_{C2}$ of the second transistor 210 due to variations in bias voltage Vdd

| Parameter | Decrease | Normal | Increase |
|---|---|---|---|
| Vdd | 2.9 V | 3.3 V | 3.6 V |
| $I_{C2}$ (mA) | 48.9 ; −2.2% | 50.0 ; 0% | 50.1 ; 0.2% |

As shown in the Table-3, the collector current $I_{C2}$ of second transistor 210 is 50 mA when the bias voltage Vdd is 3.3V. It is seen that, the collector current $I_{C2}$ of second transistor 210 decreases by only 2.2% even when the bias voltage Vdd decreases to 2.9V. It is also seen that, the collector current $I_{C2}$ of second transistor 210 increases by only 0.2% even when the bias voltage Vdd increases to 3.6V.

Hence as shown above, current mirror circuit 100 of FIG. 1 and FIG. 2 is adaptive to changes in supply voltage and ambient temperature, and tolerant to manufacturing variations. Current mirror circuit 100 provides high base current across the RF cell, which generates high output power required for RF and microwave power amplifiers.

The embodiments of the invention provide several advantages. The current mirror circuits of FIG. 1 and FIG. 2 maintain the proper bias point and operating conditions for associated circuits like RF and microwave power amplifiers. Thus, more stable operation of the associated circuits can be obtained. Further, the current source configuration (e.g., the combination of current source transistor 110 and first impedance element 120 as connected in FIG. 1 and FIG. 2) minimizes the variations in the current flowing through current source transistor 110 facilitating more stable operation.

While various embodiments of the present invention have been illustrated and described, it will be clear that the electronic components (e.g., the transistors and the impedance elements) of the current mirror circuit can be fabricated as a single integrated circuit, or as discrete circuit components connected together (as shown in FIG. 1 and FIG. 2). Further, various other possible combinations of the electronic components may also be used without departing from the scope of the invention.

While various embodiments have been illustrated and described, it will be clear that the invention is not limited to these embodiments only. For a person having ordinary skill in the art, it will be apparent that numerous modifications, changes, variations, substitutions, and equivalents can be used without departing from the scope and spirit of the invention, as described in the claims that follow.

What is claimed is:

1. A current mirror circuit comprising:

a current mirror base network comprising a first terminal, a second terminal, and a third terminal, wherein the third terminal is connected to a first bias voltage source;

a current source transistor, wherein:

a source terminal of the current source transistor is connected to the first terminal through a first impedance element, a gate terminal of the current source transistor is connected to the first terminal, and a drain terminal of the current source transistor is connected to a second bias voltage source; and an error transistor, wherein:

an emitter terminal of the error transistor is connected to the second terminal, a base terminal of the error transistor is connected to a source terminal of the current source transistor, and a collector terminal of the error transistor is connected to the third terminal.

2. The current mirror circuit according to claim 1, wherein the current mirror base network comprises a first transistor and a second transistor, wherein:

a base terminal of the first transistor is connected to a base terminal of the second transistor at the second terminal, an emitter terminal of the first transistor and an emitter terminal of the second transistor are grounded, a collector terminal of the first transistor is connected to the first terminal, and a collector terminal of the second transistor is connected to the third terminal.

3. The current mirror circuit according to claim 2, wherein each of the first transistor, the second transistor, and the error transistor is a hetero-junction bipolar transistor (HBT).

4. The current mirror circuit according to claim 2, wherein the collector current of the second transistor is proportional to the collector current of the first transistor.

5. The current mirror circuit according to claim 2, wherein the collector terminal of the second transistor is connected to the third terminal through a second impedance element.

6. The current mirror circuit according to claim 5, wherein the second impedance element is an inductor.

7. The current mirror circuit according to claim 1, wherein the first impedance element is a resistor.

8. The current mirror circuit according to claim 1, wherein the current source transistor is a depletion mode field effect transistor (FET).

9. The current mirror circuit according to claim 2, wherein the first terminal provides a feedback current signal to the gate terminal of the current source transistor resulting in a stabilized collector current of the first transistor.

10. A current mirror circuit comprising:

a current mirror base network comprising a first transistor and a second transistor, wherein:

a base terminal of the first transistor is connected to a base terminal of the second transistor, an emitter terminal of the first transistor and an emitter terminal of the second transistor are grounded, and a collector terminal of the second transistor is connected to a first bias voltage source through a second impedance element;

a current source transistor, wherein:

a source terminal of the current source transistor is connected to a collector terminal of the first transistor through a first impedance element, a gate terminal of the current source transistor is connected to the collector terminal of the first transistor, and a drain terminal of the current source transistor is connected to a second bias voltage source; and an error transistor, wherein:

an emitter terminal of the error transistor is connected to the base terminal of the first transistor, and to the base terminal of the second transistor, a base terminal of the error transistor is connected to the source terminal of the current source transistor, and a collector terminal of the error transistor is connected to the first bias voltage source.

11. The current mirror circuit according to claim 10, wherein the current source transistor is a depletion mode field effect transistor (FET).

12. The current mirror circuit according to claim 10, wherein each of the first transistor, the second transistor, and the error transistor is a hetero-junction bipolar transistor (HBT).

13. The current mirror circuit according to claim 10, wherein a stabilized collector current of the first transistor is obtained due to negative feedback provided by the first impedance element.

14. The current mirror circuit according to claim 10, wherein the collector current across the collector terminal of the second transistor is greater than the collector current across the collector terminal of the first transistor.

15. The current mirror circuit according to claim 10, wherein the emitter area of the second transistor ranges from 10 to 1000 times the emitter area of the first transistor.

16. The current mirror circuit according to claim 10, wherein the collector current of the second transistor is proportional to the collector current of the first transistor.

* * * * *